US005601286A

United States Patent [19]

Fierbaugh

[11] Patent Number: 5,601,286

[45] Date of Patent: Feb. 11, 1997

[54] DEVICE FOR PRACTICING BASEBALL HITTING

[76] Inventor: Norman R. Fierbaugh, 4679 Tamworth Dr., Paml Harbor, Fla. 34685

[21] Appl. No.: 497,854

[22] Filed: Jul. 3, 1995

Related U.S. Application Data

[63] Continuation-in-part of Ser. No. 217,204, Mar. 23, 1994, abandoned.

[51] Int. Cl.[6] ..... A63B 69/40

[52] U.S. Cl. ..... 473/429

[58] Field of Search ..... 273/26 R, 29 A, 273/196, 184 B, 197 R

[56] References Cited

U.S. PATENT DOCUMENTS 4,175,744 11/1979 Llewellyn ..... 273/26 E

*Primary Examiner*—Theatrice Brown
*Attorney, Agent, or Firm*—Dominik & Stein

[57] ABSTRACT

A new and improved device for practicing baseball hitting comprising a vertically extending post which has a plurality of spaced apertures formed therein. Further included is a base which has an upstanding centrally located brace adapted to be coupled to the post. The base is fabricated of high density polyethylene. Next included is a horizontally extending arm formed of a semi-rigid elastomeric material. The arm has an interior end and an exterior end, with an intermediate portion coupling therebetween. The intermediate portion is of a greater area adjacent the interior end than the exterior end. The interior end is formed with a bore extending therethrough. The bore has an internal diameter adapted to slidably fit over the exterior diameter of the post. The exterior end of the arm is formed in the size and shape of a baseball for being struck by a player swinging a bat. Further included are placement pins which have a head on the exterior end and an interior end having a diameter to slidably fit into the aligned apertures of the post. The placement pins are adapted to be positioned at a location immediately below the bore of the arm to ensure its retention at the vertical elevation to which it was set prior to being hit.

7 Claims, 3 Drawing Sheets

DEVICE FOR PRACTICING BASEBALL HITTING

RELATED APPLICATION

This application is a Continuation-In-Part application of U.S. application Ser. No. 08/217,204, filed on Mar. 23, 1994 (now abandoned).

BACKGROUND OF THE INVENTION

1. Field of the Invention

This invention relates to a device for practicing baseball hitting and, more particularly, to practicing hitting a baseball through a mechanism of simple construction but extended capabilities.

2. Description of the Background Art

In the game of baseball, offense constitutes fifty percent and defense constitutes fifty percent. With regard to offense, all things start with hitting. Hitting skills involve hand-eye coordination which, to a certain extent, requires natural talent. To another extent, hitting requires practice.

In the past, practicing hitting normally involved the hitter who was practicing, a pitcher to throw the ball to the batter, and a coach to observe, comment, correct and teach the hitter. Strides have been made in baseball pitching machines whereby batting may be practiced with one less person involved. Pitching machines, however, are expensive devices and require that the pitched ball be gathered up at the end of a practice session regardless how many pitched balls are hit or missed. Various other attempts have been made to provide mechanisms for rendering the practice of hitting more convenient.

By way of example, U.S. Pat. Nos. 3,883,138 to Chorey and 4,993,708 to Prosser et al relate to a batting tee apparatus and batting tee. Hamano U.S. Pat. No. 3,985,358 relates to a simulated baseball game. Ham U.S. Pat. No. 4,679,790 relates to a baseball exercising device. Kopp U.S. Pat. No. 4,907,801 relates to a rebound baseball training apparatus. Lastly, U.S. Pat. Nos. 5,133,549 to Vasquez and 5,184,816 to Zunsford relate to hitting practice devices.

As can be readily understood, present devices for practicing baseball hitting have the burden of one shortcoming or another. Some of the prior art devices allow for supporting the ball to be hit in one position only or, in the alternative, one of a plurality of positioned in a vertical line. Other baseball hitting machines feature the ball being hit to a distance from the device in which case the balls must be gathered prior to being hit again. In addition, other devices for practicing baseball hitting require the use of expensive baseball machines which are difficult to utilize and transport from one location to another. No known device for practicing baseball hitting overcomes all of the prior art shortcomings and provides a device which is convenient, supports the ball in any of a plurality of positions, horizontally or vertically, and may be utilized in the presence of the hitter only.

Therefore, it is an object of the present invention to provide an improvement which overcomes the aforementioned inadequacies of the prior art devices and provides an improvement which is a significant contribution to the advancement of the art of practicing baseball hitting.

Another object of the present invention is to provide a new and improved device for practicing baseball hitting comprising a vertically extending post which has a plurality of spaced apertures formed therein. Further included is a base which has an upstanding centrally located brace adapted to be coupled to the post. The base is fabricated of high density polyethylene. Next included is a hitting arm formed of a semi-rigid elastomeric material. The hitting arm has an interior end and an exterior end, with an intermediate portion coupling therebetween. The intermediate portion is of a greater area adjacent the interior end than the exterior end. The interior end is formed with a bore extending therethrough. The bore has an internal diameter adapted to slidably fit over the exterior diameter of the post. The exterior end of the hitting arm is formed in the size and shape of a baseball for being struck by a player swinging a bat. The hitting arm is fabricated of high density polyethylene. Further included are placement pins which have a head on the exterior end and an interior end having a diameter to slidably fit into the aligned apertures of the post. The placement pins are adapted to be positioned at a location immediately below the bore of the hitting arm to ensure its retention at the vertical elevation to which it was set prior to being hit.

It is a further object of the present invention to practice baseball hitting without the need for expensive baseball machines or the use of another player to pitch the ball.

It is a further object of the present invention to support a ball to be hit in any one of a plurality of positions, horizontally or vertically, for extending the utility of baseball practice machines.

It is a further object of the present invention to strike a ball which is part of a baseball hitting machine but then to keep the ball in a location for being hit again without the problem of retrieving the hit ball.

It is a further object of the invention to readily assemble and disassemble a baseball hitting device to facilitate its storage, relocation and transportation.

The foregoing has outlined some of the pertinent objects of the invention. These objects should be construed to merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a new and improved device for practicing baseball hitting comprising a vertically extending cylindrical post which has an exterior of a common diameter and a hollow interior. The post has a plurality of spaced apertures formed therein along one vertical line. The post is fabricated of a rigid material. Further included is a primary base formed of a rigid material in a square configuration. The primary base has a horizontal lower planar surface and a horizontal upper planar surface. The primary base has a cylindrical brace centrally located on and upstanding from the upper surface. The primary brace has an internal diameter adapted to receive the post by having its lower end slidably positioned within the brace. The primary base has a plurality of holes extending therethrough for the receipt of bolts. The holes are located at a common distance from the brace. Next included is an indoor base in a circular configuration of a diameter greater than the diagonal of the primary base. The indoor base has holes extending therethrough positionable in alignment with the holes of the primary base. The indoor base is formed of two similarly shaped semi-circular sections couplable along a diametric parting line. The parting line also includes a dove-tail projection and complimentary dove-tail recesses on each section for removable separation therebetween. Further included are a plurality of bolts which each have a head end positionable beneath the indoor base and a threaded upper end with a central section therebetween positioned through the holes of the indoor base and primary base and also including associated complimentary nuts having threaded interiors removably positioned over the threaded ends of the bolts. Further included is a cap removably positioned on the upper end of the post to effect the closure thereof. Next included is a hitting arm formed of a semi-rigid elastomeric material. The hitting arm has an interior end and an exterior end, with a intermediate portion coupling therebetween. The intermediate portion is of a greater area adjacent to the interior end than the exterior end. The interior end is formed with a bore extending therethrough. The bore has an internal diameter adapted to slidably fit over the exterior diameter of the post. The exterior end of the hitting arm is formed in the size and shape of a baseball for being struck by a player swinging a bat. The hitting arm is fabricated of high density polyethylene. Further included are a pair of placement pins which have a head on the exterior end and an interior end having a diameter to slidably fit into the aligned apertures of the post. The placement pins are adapted to be positioned at spaced locations immediately above and immediately below the bore of the hitting arm to ensure its retention at the vertical elevation to which it was set prior to being hit.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
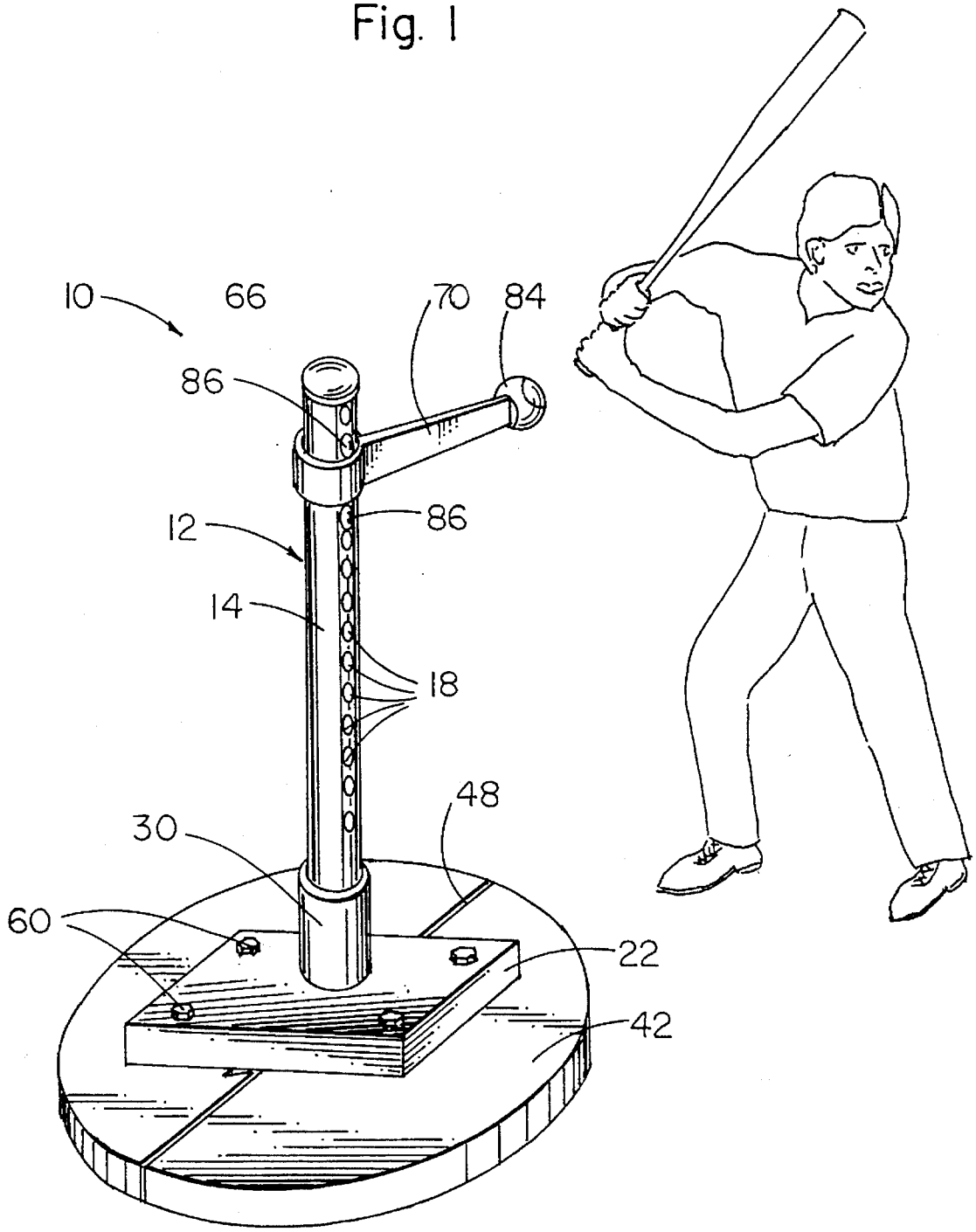
FIG. 1 is a perspective illustration of the preferred embodiment of the new and improved device for practicing baseball hitting constructed in accordance with the principles of the present invention.
Figure 3:
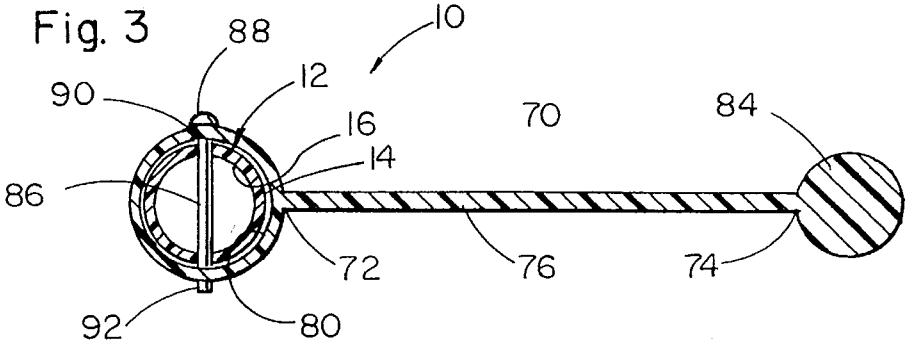
FIG. 3 is a cross sectional view taken along line 3—3 of FIG. 2.
Figure 2:
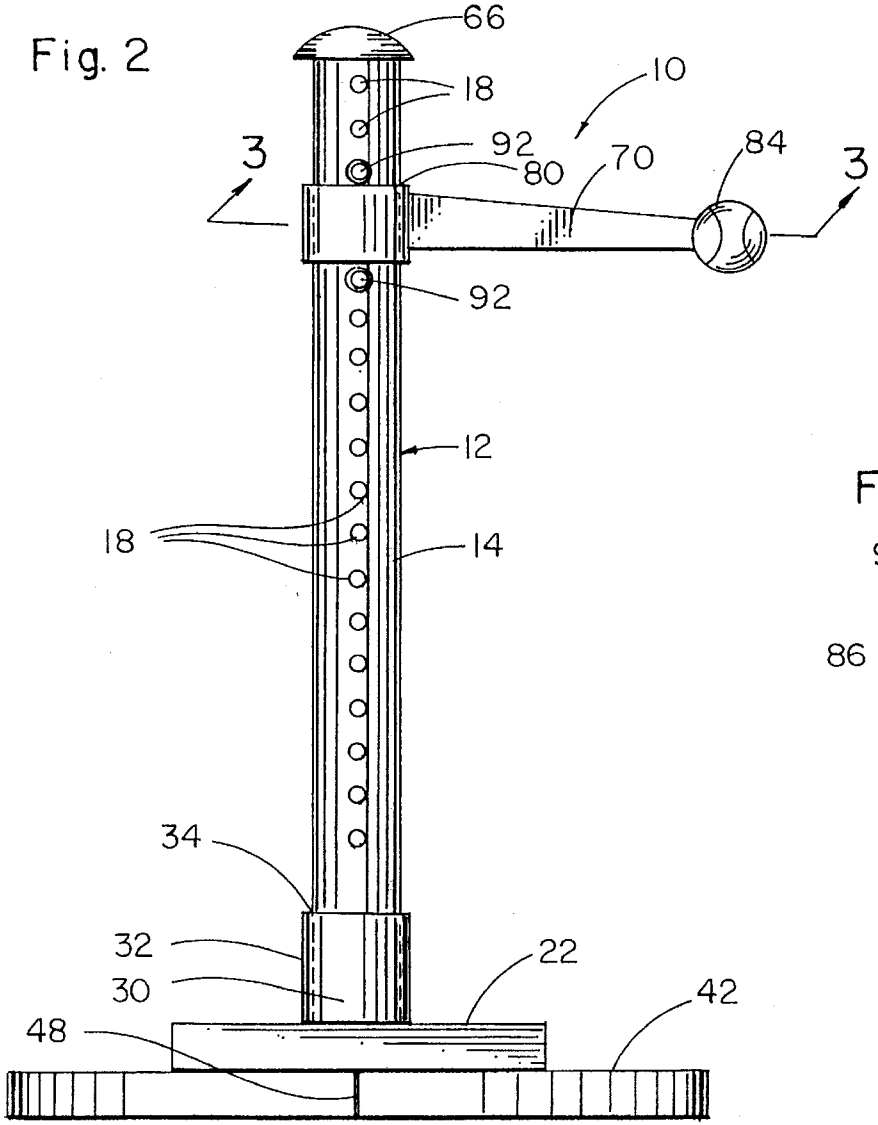
FIG. 2 is a front elevational view of the device shown in FIG. 1.
Figure 5:
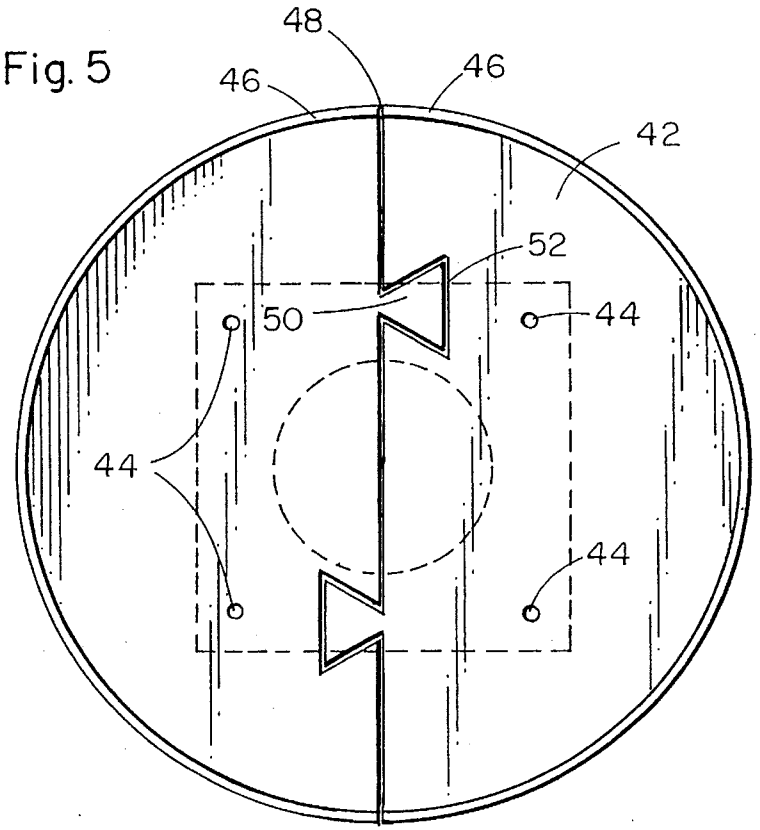
FIG. 5 is a bottom view of the device shown in FIGS. 1, 2 and 4.
Figure 4:
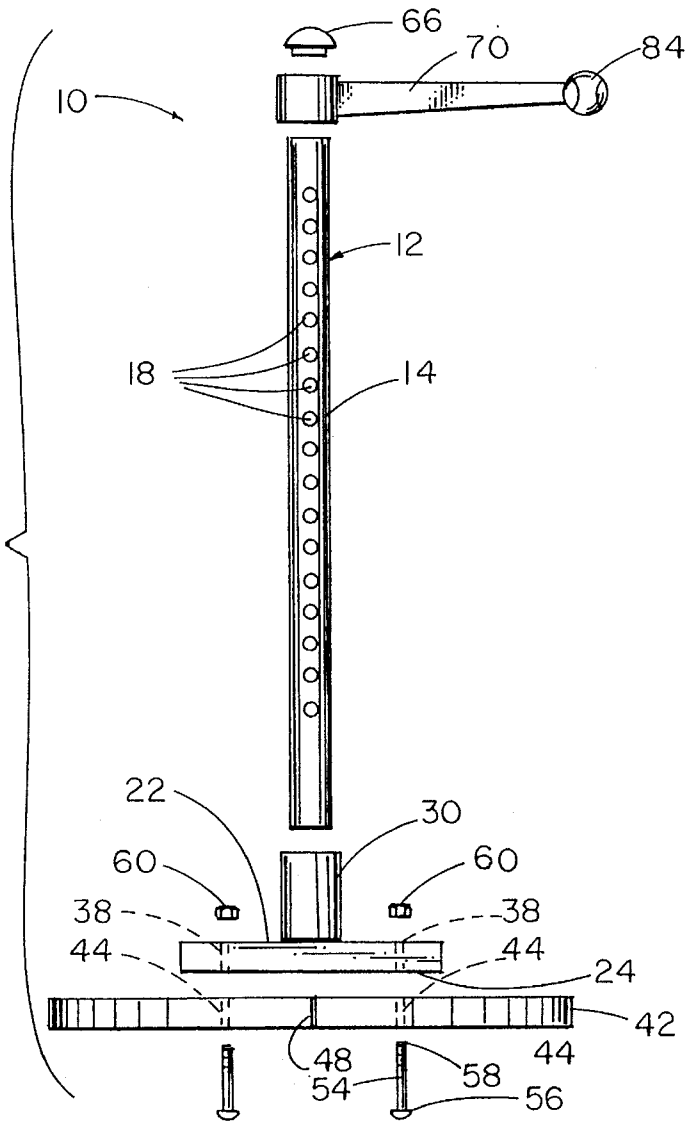
FIG. 4 is an exploded front elevational view of the device of the prior Figures.

The present invention, the new and improved device for practicing baseball hitting, is a device 10 comprised of a plurality of component elements. The component elements are specifically configured and correlated with respect to each other so as to attain the desired objectives. In their broadest context, the component elements include a post, a primary base, an indoor base, a plurality of bolts, a cap, a hitting arm and placement pins.

More specifically, the post 12 is a vertically extending element. It is hollow in configuration and circular in cross section. It has an exterior 14 of a common diameter along its length. It also has an interior 16 of a common diameter along its length. The post has a plurality of spaced apertures 18 formed along vertical lines which are diametrically opposed from each other. Such apertures are in aligned horizontal pairs for receiving placement pins, as will be described hereinafter. The post is fabricated of a rigid material, preferably plastic. The preferred plastic material is polyvinyl chloride, commonly referred to as PVC. The preferred PVC is standard grade schedule 80 PVC.

The next major component of the device is a primary base 22. The primary base is formed of a rigid material, preferably an elastomer. It is formed as a flat member with a square configuration. The primary base has a horizontal lower planar surface 24 for being positioned on the ground or floor of an area where baseball is to be practiced. It may also be placed upon an indoor base as will be described hereinafter. The primary base also has a horizontal upper planar surface 26. The upper planar surface is parallel with the lower planar surface.

The primary base also has a cylindrical brace 30 centrally located on and upstanding from the upper surface. The cylindrical brace has an exterior diameter 32 and an interior diameter 34. The interior diameter is adapted to receive the post at its exterior diameter. This is done by having the lower end of the post slidably positioned within the brace for standing vertically erect.

The primary base is formed with a plurality of holes 38 extending vertically therethrough near the corners thereof. Such holes are for the receipt of bolts for a coupling purpose as will be later described. The holes are located at a common distance from the brace.

The next major component of the device is an indoor base 42. The indoor base is of a circular configuration. It has a diameter greater than the diagonal of the primary base. The indoor base also has holes 44 extending therethrough. Such holes are positionable in alignment with the holes of the primary base. The indoor base is formed of two similarly shaped semi-circular sections 46. The sections are couplable along a diametric parting line 48. The parting line also includes a duck-tail projection 50 and a complimentary duck-tail recess 52 on each section. This is for the removable separation between the sections of the indoor base.

Coupling between the primary base and indoor base is effected through a plurality of bolts 54. Each bolt has a head 56 positionable beneath the indoor base. Each bolt also has a threaded upper end 58 with a central section therebetween. The bolts are positioned through the holes of the indoor base and primary base to effect their coupling during operation and use. Also included therewith are complimentary nuts 60. The nuts have threaded interiors removably positioned over the threaded ends of the bolts.

The preferred material for the base components is PAXON RG006E. PAXON RG006E is a trademark of the Paxton Corporation of Baton Rouge, La. and relates to a 36 mesh, UV-stabilized high density polyethylene (HDPE) powder designed for rotational molding applications. It can be processed over a wide range of molding conditions. Parts molded from PAXON RG006E exhibit excellent low temperature impact strength, a balance of stiffness and environmental stress crack resistance and good weatherability. This product meets the requirements of FDA Regulation 21CRF 177.1520 and is suitable for holding and packaging most categories of food in various services. The properties are as follows:

| | |
|---|---|
| Melt Index | 5 g/10 min |
| Density | 0.944 g/cm; |
| Tensile strength at yield | 21 MPa |
| Elongation at break | 650% |
| Tensile modulus of elasticity | 560 MPa |
| Flexural modulus | 840 MPa |
| Heat deflection temperature 66 psi load | 71 degr. C. |
| Vicat softening temperature | 126 degr. C. |
| Dart impact (–40 degr. C.) | 73 joules |
| Environmental stress crack resistance | 150 hrs. |

The upper end of the post is provided with a cap 66. The cap is removably positioned on the upper end of the post. The cap functions to effect the closure of the upper end of the post to preclude dirt or moisture from entering the center of the post.

Next provided on the device is a hitting arm 70. The hitting arm is formed of a semi-rigid elastomeric material. The hitting arm has an interior end 72. It also has an exterior end 74. An intermediate portion 76 is coupled between the interior and exterior ends. The intermediate portion is of a greater cross sectional area adjacent to the interior end than the exterior end.

The interior end is formed with a bore 80 extending therethrough and positionable about a vertical axis coextensive with the vertical axis of the post. The bore has an internal diameter adapted to slidingly fit over the exterior diameter of the post during operation and use. The exterior end of the hitting arm is formed in the size and shape of a baseball 84. Such end is for being struck by the player swinging a bat practicing his swing.

The ball and rotating arm are preferably fabricated of PAXON 7004. PAXON 7004 is a trademark of Paxton Baton Rouge, La. and relates to a UV-stabilized, 35 mesh, crosslinkable high density polyethylene (HDPE) powder intended for use in rotational molding. Properly molded parts made with PAXON 7004 exhibit excellent impact, strength tear strength, tensile creep resistance, as well as exceptional stress crack resistance. The properties of PAXON 7004 are:

| | |
|---|---|
| Density | 0.944 g/cm; |
| Tensile strength at yield | 3,000 psi |
| Elongation at break | 400% |
| Tensile modulus of elasticity | 80,000 psi |
| Flexural modulus | 100,000 psi |
| Heat deflection temperature 66 psi load | 138 degr. F. |
| Vicat softening temperature | 248 degr. F. |
| Impact brittleness temperature | <–180 degr. F. |
| Dart impact (-40 degr. C.) | 60 ft-lb. |
| Environmental stress crack resistance | >1,000 hrs. |

The last element of the device is a pair of placement pins 86. The placement pins have a head 88 on the exterior end 90. The pins also have an interior end 92. The interior end is of a diameter to slidingly fit into aligned apertures of the post. The placement pins are adapted to be positioned at spaced locations. A lower placement pin is located immediately below the bore of the hitting arm. The upper placement pin is adapted to be positioned immediately above the bore of the hitting arm. The placement of the pins ensure the retention of the bore and the entire hitting arm at an elevational orientation so that when set prior to being hit by a player swinging the bat, the bore and hitting arm be retained at the same level. In this manner, the ball at the end of the hitting arm may be placed at any elevational orientation, any horizontal orientation, forwardly or rearwardly, so that a full range of ball positions may be utilized for practicing baseball.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A new and improved device for practicing baseball hitting comprising, in combination:

a vertically extending cylindrical post having an exterior diameter and a hollow interior, the post having a plurality of horizontally extending vertically apertures formed diametrically therethrough, the post being fabricated of a rigid material;

a primary base formed of a rigid material in a square configuration having a diagonal, the primary base having a horizontal lower planar,surface and a horizontal upper planar surface, the primary base having a cylindrical brace centrally located on and upstanding from the upper surface, the cylindrical brace having an internal diameter adapted to receive the post by having its lower end slidably positioned within the brace, the primary base having a plurality of holes extending therethrough for the receipt of bolts, the holes being located at a fixed distance from the brace;

an indoor base in a circular configuration of a diameter greater than the diagonal of the primary, base, the indoor base having holes extending therethrough positioned in alignment with the holes of the primary base, the indoor base being formed of two similarly shaped semi-circular sections couplable along a diametric parting line, the parting line also including a dove-tail projection and a complementary dove-tail recess on each section for removable separation therebetween;

a plurality of bolts each having a head positioned beneath the indoor base and a threaded upper end with a central section therebetween positioned through the holes of the indoor base and primary base and also including associated complimentary nuts having threaded interiors removably positioned over the threaded ends of the bolts;

a cap removably positioned on the upper end of the post to effect the closure thereof;

substantially horizontally extending arm formed of a semi-rigid elastomeric material, said arm having an interior end and an exterior end, with a intermediate portion coupling therebetween, the intermediate portion being-of a greater area adjacent to the interior end than the exterior end, the interior end being formed with a bore extending therethrough, the bore having an internal diameter adapted to slidably fit over the exterior diameter of the post, the exterior end of said arm being formed in the size and shape of a baseball for being struck by a player swinging a bat; and a pair of placement pins having a head on the exterior end and an interior end having a diameter to slidably fit into diametrically aligned apertures of the post, the placement pins adapted to be positioned at spaced locations immediately above and immediately below the bore of said arm to ensure its retention at a vertical elevation to which it is set prior to being hit.

2. A device for practicing baseball hitting comprising:

a vertically extending post having a plurality of vertically spaced horizontally extending diametrically therethrough apertures formed;

a base having an upstanding centrally located brace adapted to be coupled to the post, the base being fabricated of high density polyethylene;

a substantially horizontally extending arm formed of a semi-rigid elastomeric material, said arm having an interior end and an exterior end, with a intermediate portion coupling therebetween, the intermediate portion being of a greater area adjacent the interior end than the exterior end, the interior end being formed with a bore extending therethrough, the bore having an internal diameter adapted to slidably fit over the exterior diameter of the post, the exterior end of said arm being formed in the size and shape of a baseball for being struck by a player swinging a bat, said arm being fabricated of high density polyethylene; and placement pins having an exterior end with a head and an interior end with a diameter to slidably fit into diametrically aligned apertures in the post, the placement pins adapted to be positioned at a location immediately below the bore of the hitting arm to ensure its positioning at any of a plurality of vertical elevations and its retention at the vertical elevation to which it is set prior to being hit and for allowing rotation of the hitting arm in a horizontal plane.

3. The device as set forth in claim 2 wherein the placement pins include at least a pair of pins, one positioned immediately above the bore of said arm and one positioned immediately below the bore of said arm.

4. The apparatus as set forth in claim 2 wherein the base includes a primary base formed of a rigid material in a square configuration, the primary base having a horizontal lower planar surface and a horizontal upper planar surface, the primary base having a cylindrical brace centrally located on and upstanding from the upper surface, the cylindrical brace having an internal diameter adapted to receive the post having its lower end slidably positioned within the brace, the primary base having a plurality of holes extending therethrough for the receipt of bolts, the holes being located at a fixed distance from the brace.

5. The apparatus as set forth in claim 4 wherein the base includes an indoor base in a circular configuration of a diameter greater than the diagonal of the primary base, the indoor base having holes extending therethrough positioned in alignment with the holes of the primary base, the indoor base being formed of two similarly shaped semi-circular sections couplable along a diametric parting line, the parting line also including a dove-tail projection and a complimentary dove-tail recess on each section for removable separation therebetween.

6. The device as set forth in claim 2 wherein said arm is fabricated of PAXON 7004 high density polyethylene.

7. The device as set forth in claim 2 wherein the base is fabricated of PAXON RG006E high density polyethylene.

* * * * *